US008973469B2

(12) United States Patent
Yang

(10) Patent No.: US 8,973,469 B2
(45) **Date of Patent: *Mar. 10, 2015**

(54) RACHET WRENCH

(76) Inventor: Yueh-Ying Yang, Taichung (TW)

( * ) Notice: Subject to any disclaimer, the term of this patent is extended or adjusted under 35 U.S.C. 154(b) by 383 days.

This patent is subject to a terminal disclaimer.

(21) Appl. No.: 13/451,572

(22) Filed: Apr. 20, 2012

(65) Prior Publication Data

US 2013/0276593 A1 Oct. 24, 2013

(51) Int. Cl.
*B25B 13/46* (2006.01)

(52) U.S. Cl.
USPC ..... 81/60; 81/63

(58) Field of Classification Search
CPC .... B25B 13/463; B25B 13/461; B25B 13/46; B25B 13/465; B25B 13/462; B25G 1/063
USPC ..... 81/60–63.2, 482
See application file for complete search history.

(56) References Cited

U.S. PATENT DOCUMENTS 8,375,830 B1 * 2/2013 Yang ..... 81/60
2011/0067531 A1 * 3/2011 Suzuki ..... 81/63
2013/0340574 A1 * 12/2013 Buchanan ..... 81/60

* cited by examiner

*Primary Examiner* — Robert Scruggs

(57) ABSTRACT

A ratchet wrench mainly includes a main body installed with a driving gear and a driven gear respectively having teeth formed spirally and engaged with each other. A confining chamber in the main body has an inner wall formed with ratchet teeth able to restrictively lock with ratchet teeth formed on the teeth of the driven gear. An interactive member is installed in an insert hole of the driven gear, with one end connected with the orientating member and another end positioned on the cover. A pressing piece is fixed on the interactive member, confined in the insert hole of the driven gear. A spring is located between the pressing piece and the driven gear. By switching the orientating member, the driving gear can easily change rotating direction, with a strong locking effect.

2 Claims, 7 Drawing Sheets

RACHET WRENCH

BACKGROUND OF THE INVENTION

1. Field of the Invention

This invention relates to a ratchet wrench, particularly to one facilitating to alter a rotation direction of a driving gear by change-over of an orientating member, able to achieve excellent efficacy of engagement and braking of the driving gear. In addition, it can stabilize transmission when the ratchet wrench works.

2. Description of the Prior Art

Generally, a ratchet wrench cooperating with different sleeves is employed for locking and detaching different kinds of bolts or nuts. A conventional ratchet wrench 1, as shown in FIG. 1, includes a main body 10 formed with an accommodating groove 100 and a receiving groove 101, the accommodating groove 100 bored with a through hole 102, and the receiving groove 101 provided with a control grip hole 103 and having a wall surface disposed with a recessed hole 104. A ratchet 11 is received in the accommodating groove 100, and an adjusting block 12 is set in the receiving groove 101 of the main body 10, with the ratchet teeth 110 of the ratchet 11 meshed with the teeth 120 at one side of the adjusting block 12. The ratchet 11 is mounted thereon with a sleeve engaging post 111 while the adjusting block 12 has an intermediate portion of another side provided with a projection 121 having two sides respectively formed with a concave arcuate surface 122. The recessed hole 104 of the main body 10 is fixed therein with a positioning ball 13 and a spring 14, the positioning ball 13 resisting against one of the two concave arcuate surfaces 122. A control grip 15 is positioned at an outer side of the main body 10 and connected with the adjusting block 12 by a shaft rod 16, and a blocking plate 17 to be covered and secured on the main body 10 by fixing members 18 is bored with a through hole 170 for the sleeve engaging post 111 of the ratchet 11 to be inserted therethrough and a shaft hole 171 for receiving the shaft rod 16 therein. Thus, when the control grip 15 is operated to actuate the adjusting block 12 to rotate and have one end transferred to closely lean on one sidewall of the receiving groove of the main body 10, the ratchet 11 will be held and braked by the adjusting block 12 to carry out one-way gearing.

However, the engagement of the ratchet 11 of the conventional ratchet wrench 1 with the teeth 120 of the adjusting block 12 is point contact or line contact; therefore, the ratchet 11 and the teeth 120 of the adjusting block 12 cannot stably carry out meshing transmission, likely to produce tooth skipping and indefinite gearing. In addition, when the adjusting block 12 is actuated to carry out braking to the ratchet 11, it is only by mutual resisting and engagement of the wall surfaces of the adjusting block 12 and of the receiving groove 101, which are smooth surfaces unable to produce great frictional force, thus failing to attain good effect of engagement and braking and also apt to slip off.

SUMMARY OF THE INVENTION

The object of this invention is to offer a ratchet wrench, not only achieving excellent efficacy of engagement and braking while changing rotating direction of a driving gear, but also stabilizing transmission while the ratchet wrench is working.

The ratchet wrench mainly includes a main body, a driving gear, a driven gear and a cover.

The main body is provided with an operating end having a recessed surface formed in one side, an accommodating chamber and a confining chamber formed inside the recessed surface to communicate with each other, a through hole bored in another side of the operating end to communicate with the accommodating chamber, and an orientating member installed at an outside.

The driving gear is installed in the accommodating chamber, provided with plural gear teeth, a positioning projection located at one end for being inserted in the through hole of the main body, and a sleeve-engaging rod located at another end.

The driven gear is set in the confining chamber, provided with plural gear teeth to engage with the gear teeth of the driving gear.

The cover is laid in the recessed surface of the main body, provided with a through hole for the sleeve-engaging rod of the driving gear to pass through.

The ratchet wrench is characterized by having plural ratchet teeth formed on an inner wall of the confining chamber of the main body and the gear teeth of the driven gear also formed with plural ratchet teeth respectively so that the ratchet teeth of the driven gear can restrictively interlock with those ratchet teeth on the confining chamber. The gear teeth of driving gear and the gear teeth of driven gear are formed spirally in order to match and work with each other. The driving gear is bored with a through hole for being inserted with an interactive member having one end connected with the orientating member outside the main body and another end positioned on the cover. The interactive member is further provided with an insert hole for being inserted with a projected bar of a pressing piece. A spring is mounted on the projected bar of the pressing piece between the pressing piece and the interactive member.

Furthermore, the operating end of the main body has another side formed with a recessed groove corresponding to the confining chamber. The recessed surface of the main body is bored with plural insert holes to communicate with the recessed groove. The interactive member is provided with a positioning projection located at one end, and a positioning bar located at another end. Laid in the recessed groove of the main body is a blocking plate, which is provided with a through hole for being inserted by the positioning projection of the interactive member, and plural threaded holes to correspond to the insert holes of the recessed groove of the main body. The orientating member is installed at an outside of the blocking plate, bored with an insert hole for a fixing member to pass through to fix on the positioning projection of the interactive member. The cover is further bored with a positioning hole for the positioning bar of the interactive member to insert therein, and plural insert holes corresponding to the insert holes in the recessed surface of the main body. And plural screws can penetrate through the insert holes of the cover and the main body to threadably engage with the threaded holes of the blocking plate.

BRIEF DESCRIPTION OF DRAWINGS

This invention is better understood by referring to the accompanying drawings, wherein.

DETAILED DESCRIPTION OF THE PREFERRED EMBODIMENT

Figure 1:
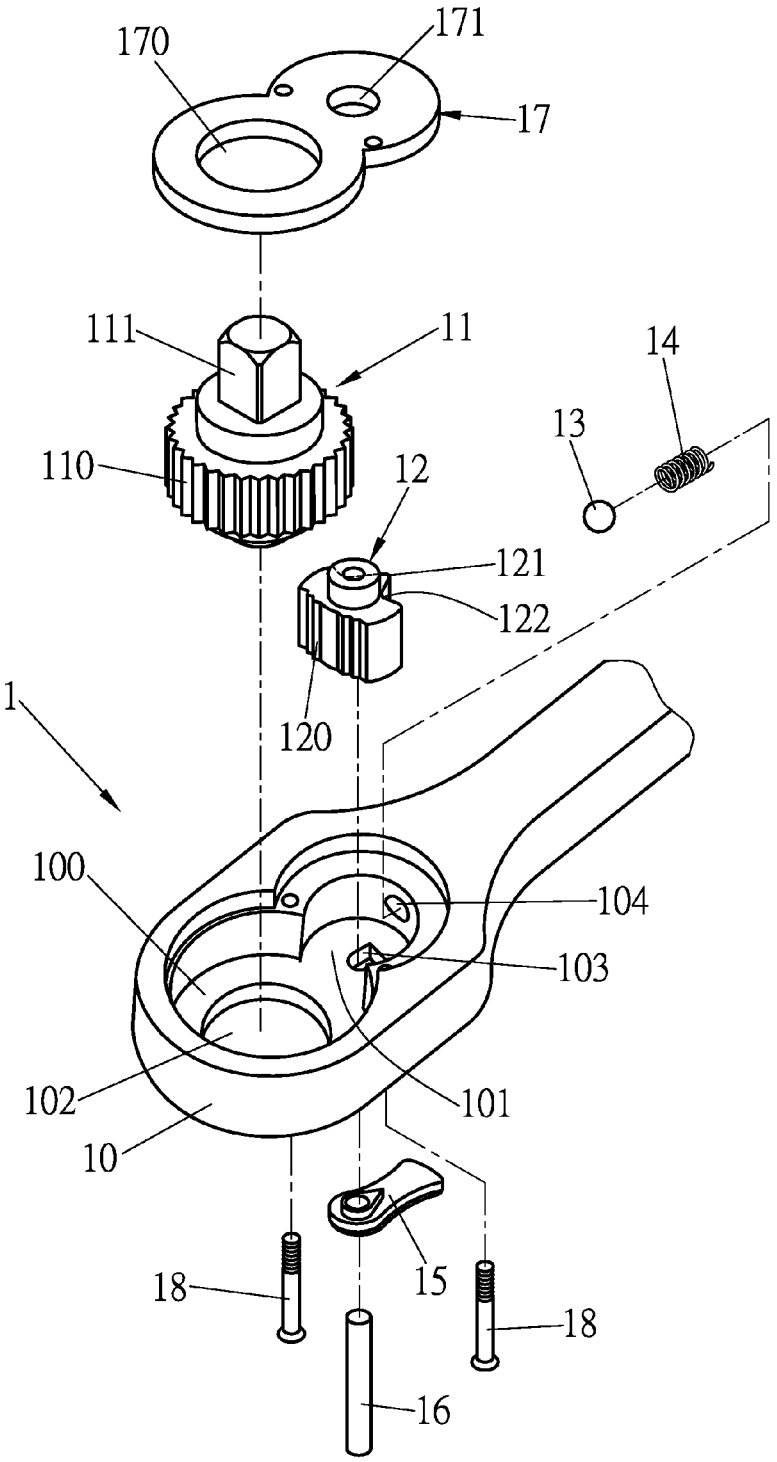
FIG.1 (PRIOR ART)
FIG. 1 is an exploded perspective view of a conventional ratchet wrench.
Figure 2:
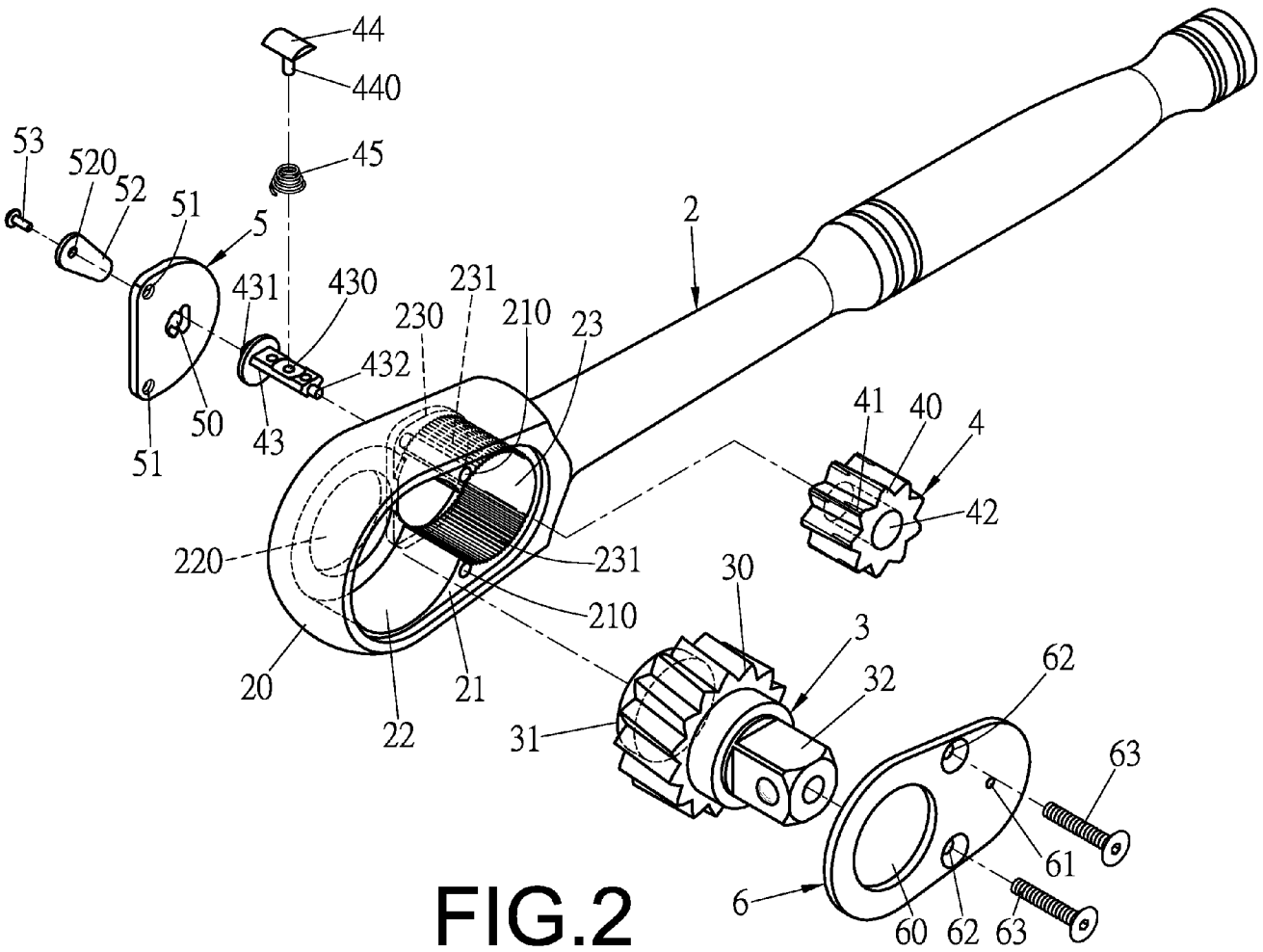
FIG. 2 is an exploded perspective view of a preferred embodiment of a ratchet wrench in the present invention.
Figure 3:
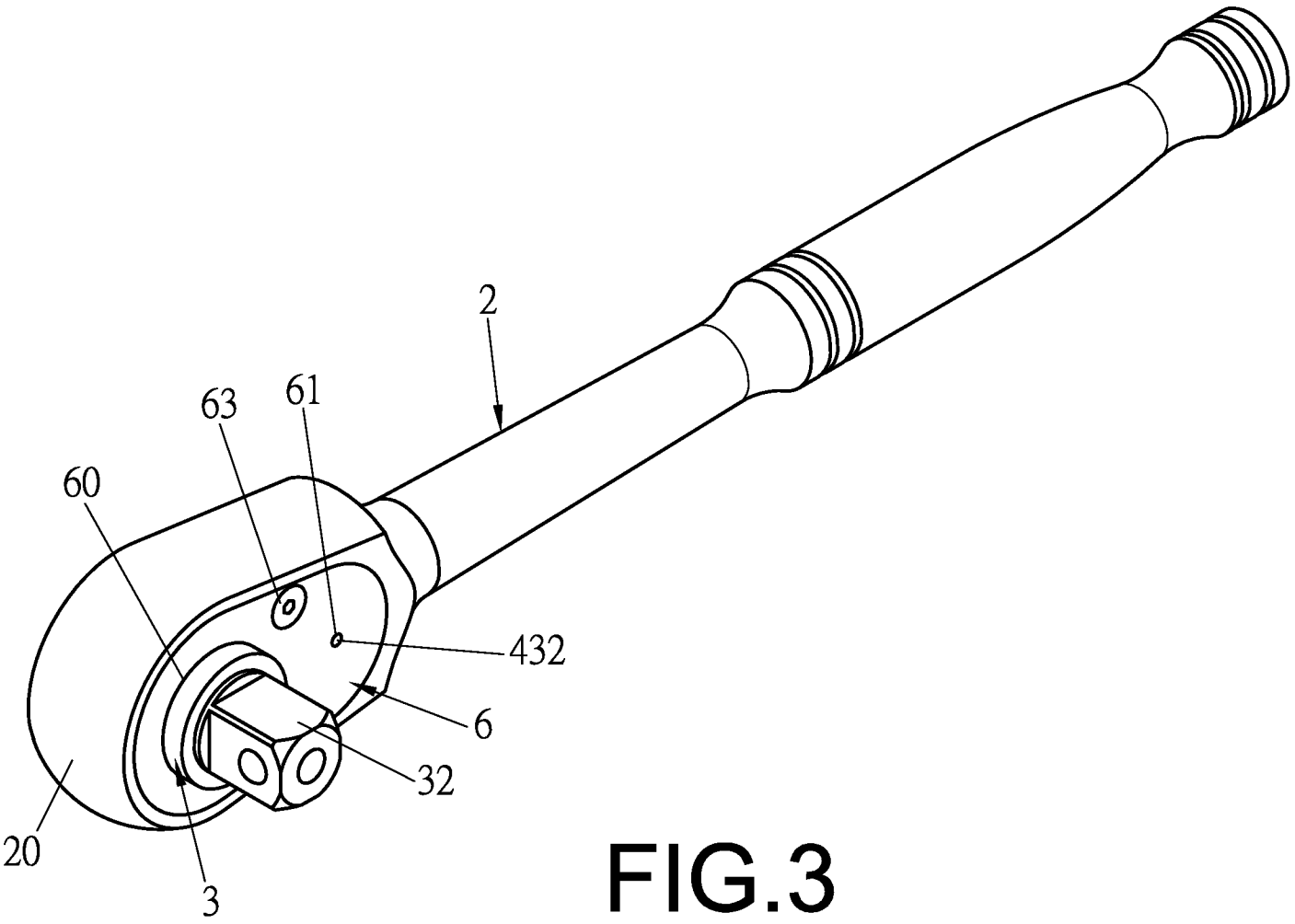
FIG. 3 is a perspective view of the preferred embodiment of a ratchet wrench in the present invention.

As shown in FIGS. 2~5, a preferred embodiment of a ratchet wrench in the present invention includes a main body 2, a driving gear 3, a driven gear 4, a blocking plate 5 and a cover 6.

The main body 2 is provided with an operating end 20 having a recessed surface 21 formed in one side, with an accommodating chamber 22 and a confining chamber 23 formed to communicate mutually inside the recessed surface 21. A through hole 220 is bored in one side of the operating end 20 to communicate with the accommodating chamber 22. A recessed groove 230 is bored in another side of the operating end 20 to correspond to the position of confining chamber 23. The recessed surface 21 is bored with plural holes 210 are bored to communicate with the recessed groove 230. The confining chamber 23 has two corresponding portions of the interior wall formed with plural ratchet teeth 231.

The driving gear 3 is installed in the accommodating chamber 22, provided with plural gear teeth 30 formed spirally, a positioning projection 31 located at one end and a sleeve-engaging rod 32 located at another end.

The driven gear 4 is installed in the confining chamber 23, provided with plural gear teeth 40 to spirally engage with the gear teeth 30 of the driving gear 3. Each of the gear teeth 40 possesses plural ratchet teeth 41. In addition, the driven gear 4 is bored with an insert hole 42 inserted with an interactive member 43, which has an insert hole 430, a positioning projection 431 located at one end and a positioning bar 432 located at another end. A pressing piece 44 has a projected bar 440 inserted in the insert hole 430, and a spring 45 is mounted on the projected bar 440 between the interactive member 43 and the pressing piece 44.

The blocking plate 5 is laid in the recessed groove 230 of the main body 2, provided with a through hole 50, plural threaded holes 51 corresponding to the insert holes 210 of the main body 2, an orientating member 52 installed on the outside, and a fixing member 53 inserted through an insert hole 520 of the orientating member 52 to engage with the positioning projection 431 of the interactive member 43.

The cover 6 is laid in the recessed surface 21 of the main body 2, provided with a through hole 60, a positioning hole 61 employed to let the positioning bar 432 to pass through, and plural insert holes 62 corresponding to the insert holes 210 of the recessed surface 21 to respectively let plural screws 63 pass through.

In assembling, as shown in FIGS. 2~5, the positioning projection 431 of the interactive member 43 is first inserted in the through hole 50 of the blocking plate 5, with the fixing member 53 to position the orientating member 52 on the positioning projection 431 outside the blocking plate 5. Then, the blocking plate 5 is placed on the recessed groove 230 of the main body 2. Next, the spring 45 is mounted around the projected bar 440 of the pressing piece 44, with the projected bar 440 inserted in the insert hole 430 of the interactive member 43 so that the interactive member 43, the pressing piece 44 and the spring 45 are enclosed in the confining chamber 23 of the main body 2. Then, the driven gear 4 is laid in the confining chamber 23 of the main body 2, with the interactive member 43, the pressing piece 44 and the spring 45 inserted in the insert hole 42. Next, the driving gear 3 is placed in the accommodating chamber 22 of the main body 2, enabling the gear teeth 40 of the driven gear 4 to engage with the gear teeth 30 of the driving gear 3 and the threaded holes 51 of the blocking plate 5 to exactly correspond to the insert holes 210 of the main body 2. The cover 6 is laid in the recessed surface 21 of the main body 2, with the engaging rod 32 in the accommodating chamber 22 of the main body 2 to penetrate the through hole 60, and the positioning bar 432 of the interactive member 43 in the insert hole 42 is inserted in the positioning hole 61. Then the screws 63 are inserted through the insert holes 62 of the cover 6 and the insert holes 210 of the main body 2 to threadably engage with the threaded holes 51 of the blocking plate 5. Hence, the driving gear 3 and the driven gear 4 are fixed in the accommodating chamber 22 and the confining chamber 23 of the main body 2 respectively, finishing the assembly of the ratchet wrench.

Figure 4:
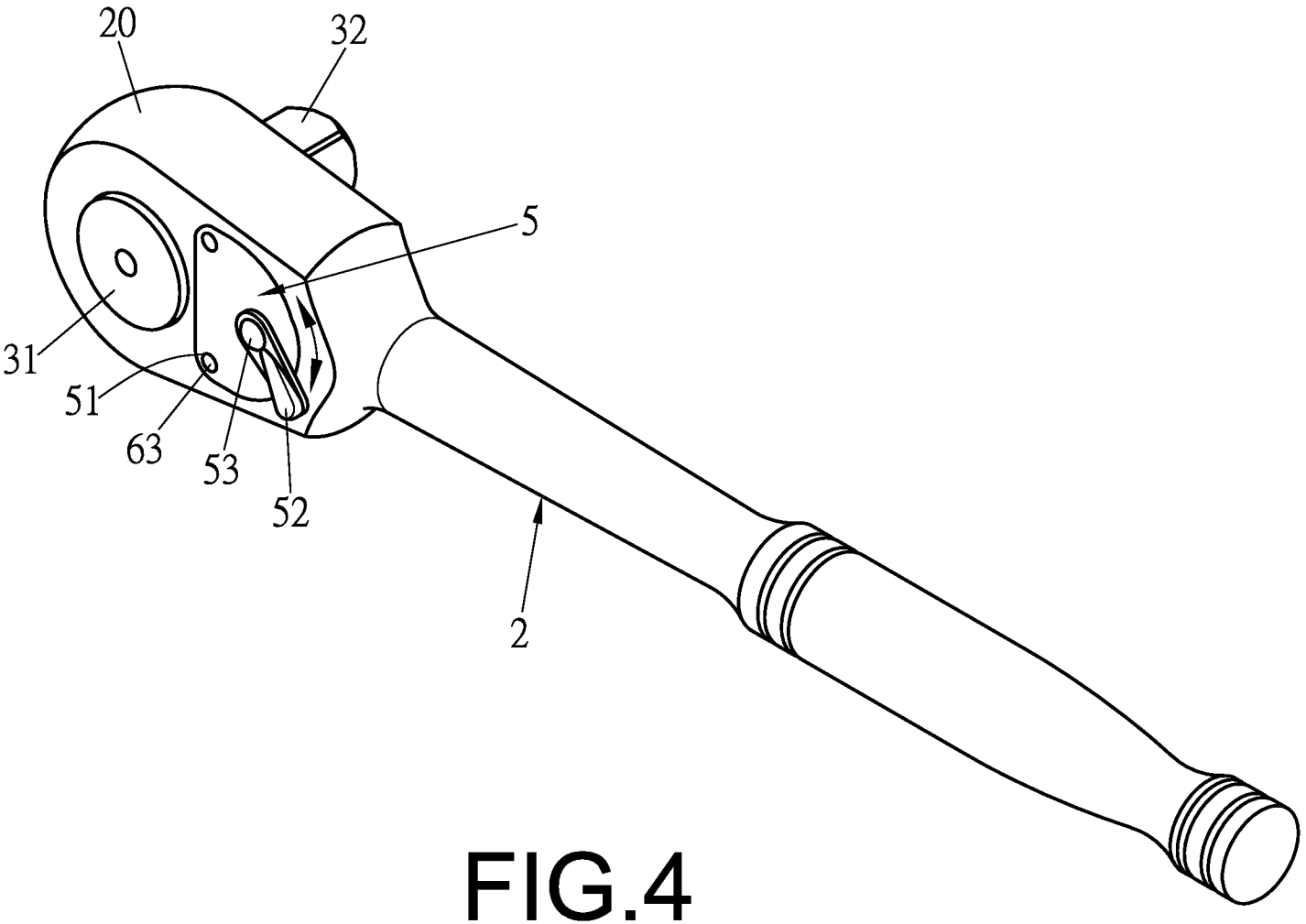
FIG. 4 is another perspective view of the preferred embodiment of a ratchet wrench in the present invention.
Figure 5:
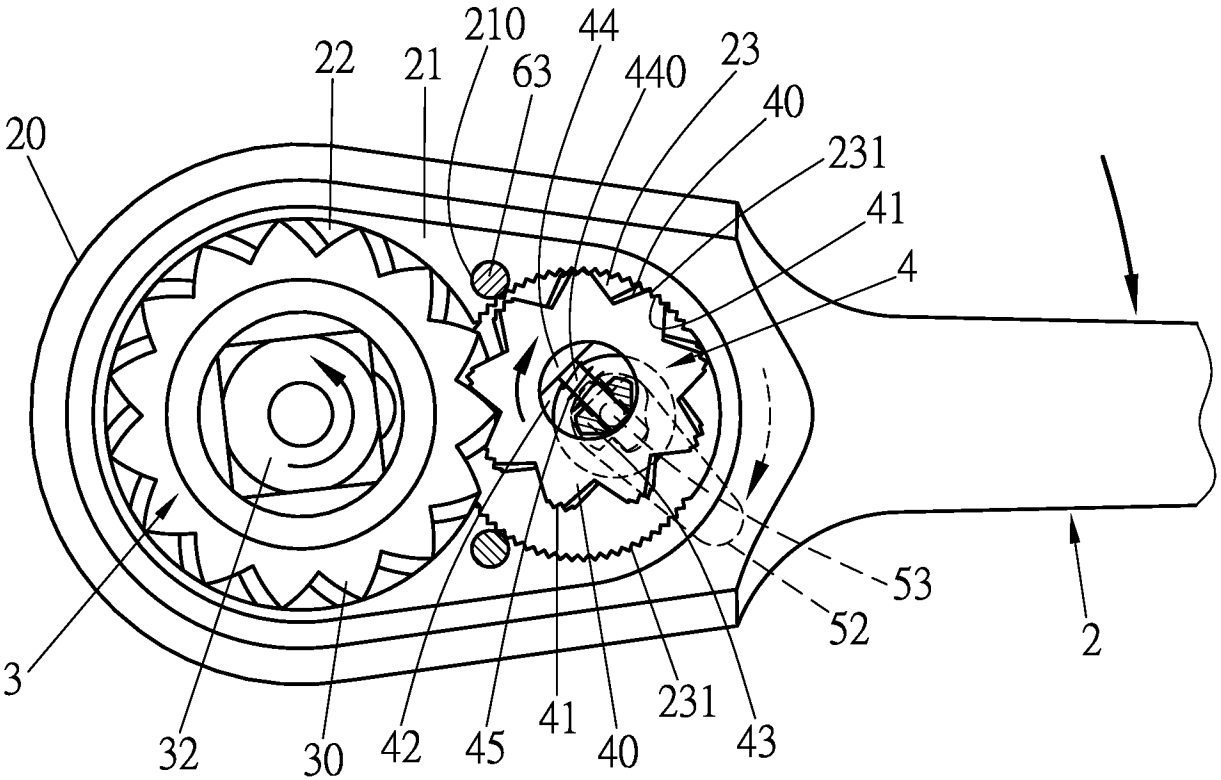
FIG. 5 is a cross-sectional view of the preferred embodiment of a ratchet wrench in the present invention, showing a driving gear being restricted by a driven gear to enable a main body to rotate in a direction for effective gearing.
Figure 6:
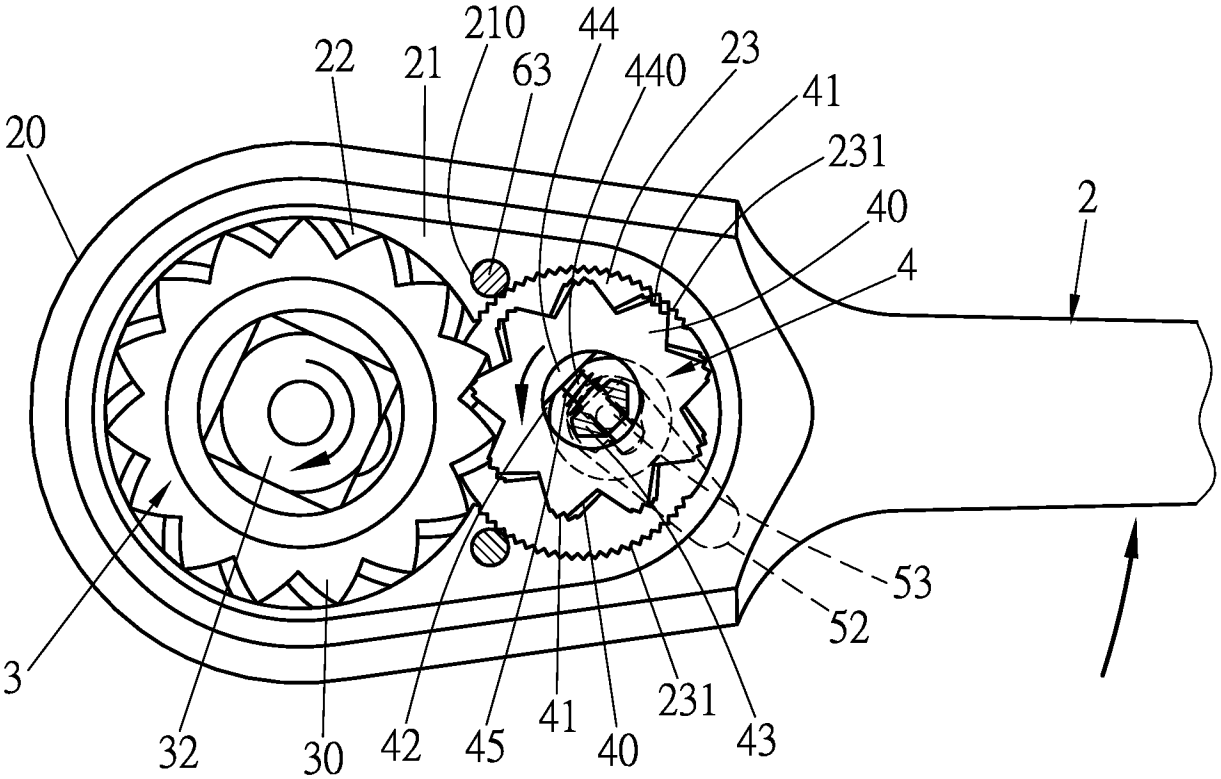
FIG. 6 is a cross-sectional view of the preferred embodiment of a ratchet wrench in the present invention, showing the driving gear being freed to enable the main body to carry out idle rotation in a direction opposite to that in FIG. 5.

FIGS. 4~7 show how to operate the ratchet wrench. If the direction of the main body 2 intends to change, it just needs to switch the orientating member 52 to the direction as expected. As shown in FIGS. 4 and 5, if the main body 2 intends to operate clockwise, then, all need to do is switching the direction of orientating member 50 clockwise so that it can drive the interactive member 43 to spin. Successively, the interactive member 43 is able to drive the pressing piece 44 to rotate in the insert hole 42 of the driven gear 4. By the time, as the pressing piece 44 is elastically squeezed by the spring 45, the driven gear 4 can be moved upward and is as well displaced to contact the upper interior wall of the confining chamber 23 of the main body 2, as shown in FIG. 5, with the ratchet teeth 41 on the teeth 40 of the driven gear 4 interlocked with the ratchet teeth 231 of the confining chamber 23, making another lower portion of the confining chamber 23 forming a space. As the turning direction of the main body 2 is turned clockwise, the gear teeth 30 of the driving gear 3 will drive the gear teeth 40 of the driven gear 4 counterclockwise, so the driven gear 4 to rotate clockwise as the rotating direction of main body 2 as shown in FIG. 5. However, the ratchet teeth 41 of the driven gear 4 are restrictively engaged with the ratchet teeth 231 of the confining chamber 23, making the driving gear 3 unable to turn around so that a sleeve tool (not shown in FIGS.) engaged with the sleeve-engaging rod 32 of the driving gear 3 can work to screw or unscrew a nut or a bolt. However, if the orientating member 52 is switching counterclockwise to lower position, then, the main body 2 is turned counterclockwise, the driving gear 3 can drive the driven gear 4 to slightly shift downward in the confining chamber 23 as shown in FIG. 6. Hence, the ratchet teeth 41 of the gear teeth 40 of the driven gear 4 won't be tightly engaged with the ratchet teeth 231 of the confining chamber 23, so that the driven gear 4 can't be driven by the driving gear 3.

Figure 7:
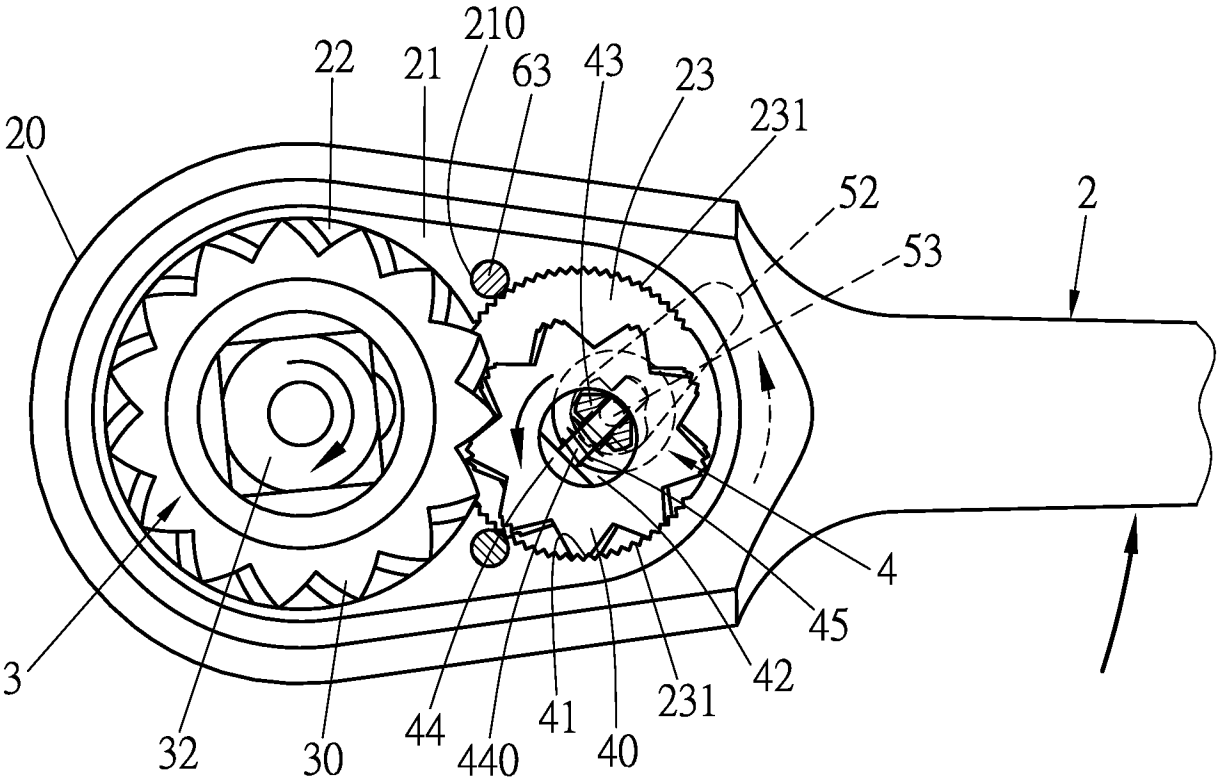
FIG. 7 is a cross-sectional view of the preferred embodiment of a ratchet wrench in the present invention, showing the driving gear being restricted by the driven gear to enable the main body to rotate in another direction for effective gearing.

When the ratchet wrench is to be operated counterclockwise, only the orienting member 52 is switched upward counterclockwise in order to change over, moving the orienting member 52 upward counterclockwise to the needed direction for rotating the body 2, as shown in FIGS. 4 and 7. Then the orienting member 52 can drive the interactive member 43 to turn counterclockwise, with the interactive member 43 pushing the pressing piece 44 to turn in the insert hole 42 of the driven gear 4. Then the driven gear 4 moves downward in the confining chamber 23 of the main body 2, hence, a space is formed in an upper portion of the confining chamber 23, with the spring 45 elastically pushing the driven gear 4 move downward and contact with a lower interior wall of the confining chamber 23 as shown in FIG. 7. When the ratchet wrench is turned counterclockwise, the teeth 30 of the driving gear 3 turns clockwise to mesh with the teeth 40 of the driven gear 4 and force the driven gear 4 to turn counterclockwise, with the ratchet teeth 41 closed engage with the ratchet teeth 231 of the lower portion of the driven gear 4, producing a braking state to stop the driving gear 3 completely. So, a sleeve tool, not shown in Figs, fixed on the sleeve-engaging rod 32 of the driving gear 3 can loose or screw tightly a nut or a bolt. If the orienting member 52 is turned counterclockwise upward and the main body 2 is turned clockwise, the driving gear 3 can drive the driven gear 4 slightly toward the upper portion of the confining chamber 23, forcing the ratchet teeth 41 of the gear teeth 40 of driven gear 4 mesh with the ratchet teeth 231 of the confining chamber 23, with the driven gear 4 driven by the driving gear 3 to turn, producing idle rotation.

Therefore, with the ratchet teeth 41 on the gear teeth 40 of the driven gear 4 to restrictively interlock with the ratchet teeth 231 of the confining chamber 23, and with the driving gear 3 to cooperate with the driven gear 4, the ratchet wrench of the invention can work as a stepless driving tool, with a firmly restrictive effect to prevent any slipping off. Moreover, as the gear teeth 30 of the driving gear 3 and the gear teeth 40 of the driven gear 4 are formed spirally, enlarging mutual contact area to make their engagement and transmission firmly, so that the condition like "slipping off" or "transmitting improperly" won't be happened.

While the preferred embodiment of the invention has been described above, it will be recognized and understood that various modifications may be made therein and the appended claims are intended to cover all such modifications that may fall within the spirit and scope of the invention.

What is claimed is:

1. A ratchet wrench comprising:

a main body provided with an operating end having a recessed surface formed in one side, an accommodating chamber and a confining chamber formed inside said recessed surface to communicate with each other, a through hole bored in another side of said operating end to communicate with said accommodating chamber, an orientating member installed at an outside of said main body;

a driving gear installed in said accommodating chamber and provided with plural gear teeth, a positioning projection located at one end of said driving gear for being inserted in said through hole of said main body, an sleeve-engaging rod located at another end of said driving gear;

a driven gear installed in said confining chamber and provided with plural gear teeth to engage with said teeth of said driving gear;

a cover laid in said recessed surface of said main body and provided with a through hole for said sleeve-engaging rod of said driving gear to pass through; and said ratchet wrench characterized by having plural ratchet teeth formed on inner wall of said confining chamber of said main body and plural ratchet teeth formed on said gear teeth of said driven gear so that said gear teeth of said driven gear can restrictively interlock with said ratchet teeth of said confining chamber, said gear teeth of said driving gear and said gear teeth of said driven gear being formed spirally, said driven gear bored with an insert hole for being inserted with an interactive member having one end connected with said orientating member outside said main body and another end positioned on said cover, said interactive member further provided with an insert hole for being inserted with a projected bar of a pressing piece, a spring mounted around said projected bar of said pressing piece between said pressing piece and said interactive member.

2. The ratchet wrench as claimed in claim 1, wherein said operating end of said main body has another side formed with a recessed groove to correspond to said confining chamber, said recessed surface of said main body bored with plural insert holes to communicate with said recessed groove, said interactive member provided with a positioning projection located at one end and a positioning bar located at another end, a blocking plate laid in said recessed groove of said main body and provided with a through hole for being inserted by said positioning projection of said interactive member, said blocking plate further provided with plural threaded holes to correspond to said insert holes of said recessed groove of said main body, said orientating member installed at an outside of said blocking plate and bored with an insert hole for a fixing member to pass through to fix on said positioning projection of said interactive member, said cover further bored with a positioning hole for said positioning bar of said interactive member to insert and with plural insert holes corresponding to said insert holes in said recessed surface of said main body so that plural screws can penetrate through said insert holes of said cover and said main body to threadably engage with said threaded holes of said blocking plate.

* * * * *